US011661302B2

(12) United States Patent
Atsumi et al.

(10) Patent No.: US 11,661,302 B2
(45) Date of Patent: May 30, 2023

(54) SHEET FOLDING APPARATUS AND IMAGE FORMING APPARATUS

(71) Applicants: Keiichi Atsumi, Yamanashi (JP); Akihito Sakano, Yamanashi (JP); Akito Yoda, Yamanashi (JP)

(72) Inventors: Keiichi Atsumi, Yamanashi (JP); Akihito Sakano, Yamanashi (JP); Akito Yoda, Yamanashi (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 17/560,829

(22) Filed: Dec. 23, 2021

(65) Prior Publication Data

US 2022/0204307 A1 Jun. 30, 2022

(30) Foreign Application Priority Data

Dec. 24, 2020 (JP) ..... JP2020-214610
Nov. 26, 2021 (JP) ..... JP2021-191712

(51) Int. Cl.
*B65H 45/14* (2006.01)
*B65H 37/06* (2006.01)
(Continued)

(52) U.S. Cl.
CPC ..... *B65H 37/06* (2013.01); *B65H 5/062* (2013.01); *B65H 7/02* (2013.01); *B65H 45/04* (2013.01);
(Continued)

(58) Field of Classification Search
CPC ..... B31F 1/00; B31F 1/0006; B31F 1/0035; B65H 45/04; B65H 45/12; B65H 45/14;
(Continued)

(56) References Cited

U.S. PATENT DOCUMENTS 8,256,757 B2 * 9/2012 Imazu ..... B65H 45/148 270/32
9,199,425 B2 * 12/2015 Yamaguchi ..... B42C 19/02
(Continued)

FOREIGN PATENT DOCUMENTS

JP 2002-068583 A 3/2002
JP 2005-067741 A 3/2005

OTHER PUBLICATIONS

Espacenet translation of JP2002068583A; http://translationportal.epo.org/emtp/translate/?ACTION=description-retrieval&COUNTRY=JP&ENGINE=google&FORMAT=docdb&KIND=A&LOCALE=en_EP&NUMBER=2002068583&OPS=ops.epo.org/3.2&SRCLANG=ja&TRGLANG=en (Year: 2002).*

*Primary Examiner* — Leslie A Nicholson, III
(74) *Attorney, Agent, or Firm* — Manabu Kanesaka

(57) ABSTRACT

A sheet folding apparatus includes a folding roller pair that forms a first fold line owing to that the folding roller pair nips a first position of the sheet, which has a loop to be formed on an upstream side of the folding roller pair due to continuous conveyance of the sheet by a conveyance roller pair in a stopped state in which a front end of the sheet being conveyed from the conveyance roller pair is nipped by the folding roller pair, as starting conveyance of the sheet while a pushing plate is pushing the sheet and moving toward the folding roller pair, and thereafter, forms a second fold line owing to that the folding roller pair nips a second position of the sheet with the loop formed as aligning with a rear end of the sheet.

13 Claims, 12 Drawing Sheets

(51) Int. Cl.
*B65H 5/06* (2006.01)
*B65H 45/04* (2006.01)
*B65H 7/02* (2006.01)

(52) U.S. Cl.
CPC ..... *B65H 2511/13* (2013.01); *B65H 2801/06* (2013.01); *B65H 2801/27* (2013.01)

(58) Field of Classification Search
CPC ..... B65H 45/20; B65H 2801/27; B65H 2301/51232; B65H 2701/13212
USPC ..... 270/32, 45; 493/421
See application file for complete search history.

(56) References Cited

U.S. PATENT DOCUMENTS

| | | | | |
|---|---|---|---|---|
| 10,974,922 | B2 * | 4/2021 | Enomoto | B65H 45/30 |
| 11,066,269 | B2 * | 7/2021 | Takahashi | B65H 45/18 |
| 11,072,511 | B2 * | 7/2021 | Enomoto | B65H 45/18 |
| 11,167,950 | B2 * | 11/2021 | Atsumi | B65H 45/20 |
| 11,186,460 | B2 * | 11/2021 | Komada | B65H 45/18 |
| 11,203,505 | B2 * | 12/2021 | Enomoto | B65H 45/18 |
| 2017/0205751 | A1 * | 7/2017 | Hirano | B65H 45/18 |
| 2020/0180897 | A1 * | 6/2020 | Shimizu | B65H 45/20 |

* cited by examiner

SHEET FOLDING APPARATUS AND IMAGE FORMING APPARATUS

TECHNICAL FIELD

The present invention relates to a sheet folding apparatus for performing folding processing on a sheet, and an image forming apparatus including a sheet folding mechanism for performing the folding processing on a sheet.

BACKGROUND ART

Conventionally, a sheet folding apparatus for performing folding processing at a predetermined position on a sheet on which an image is formed by an image forming apparatus such as a copying machine or a printer is widely known. The folding processing includes double folding in which a sheet is folded at a center position, triple folding in which a sheet is folded inward at two positions, and so-called Z-folding in which a sheet is alternately folded inward and outward to be folded in three.

There has been known a sheet folding apparatus in which a conveyance roller pair is provided on the upstream side of a horizontal upper guide plate, a folding roller pair is provided on the downstream side thereof, and a sheet guiding-deflecting member (i.e., a pushing member) is provided on the upstream side of the folding roller pair (e.g., see Patent Documents 1 and 2).

The apparatus described in Patent Document 1 includes a sheet conveyance unit for conveying a sheet, and a sheet folding unit for performing folding operation of the sheet conveyed by the sheet conveyance unit. In this document, the sheet is conveyed by the sheet conveyance unit in a state in which the front end of the sheet is nipped and stopped by the sheet folding unit, and the sheet is bent and slacked between the sheet conveyance unit and the sheet folding unit. There is disclosed a technique for forming Z-folding on the conveyed sheet by pushing a sheet guide unit (pushing member) into a slacked part of the sheet.

In the apparatus described in Patent Document 2, similarly to the apparatus described in Patent Document 1, a slacked part is formed in a sheet, and when the sheet guide unit is pushed into the slacked part, a roller arranged at the front end of the sheet guide unit is pressed against a guide for guiding the sheet. This document discloses a technique in which the sheet guide unit moves on the sheet along the guide while maintaining the pressed state and a folding position of the sheet is guided to the sheet folding unit.

PRIOR ART DOCUMENT

Patent Document

Patent Document 1: Japanese Patent Application Laid-Open No. 2002-68583

Patent Document 2: Japanese Patent Application Laid-Open No. 2005-67741

DISCLOSURE OF INVENTION

Problems to be Solved by the Invention

However, in the sheet folding apparatus described in the above-mentioned patent document, in a state in which the sheet folding roller pair holds the front end of the sheet and stops, the sheet guiding unit pushes the part which is to be the folding line of the sheet and approaches the sheet folding roller pair. Accordingly, there is a problem that the load applied to the sheet guiding unit is large.

Furthermore, when the stiffness of the sheet is high or the thickness of the sheet is large, the load applied to the sheet guide unit is further increased. Therefore, there is a fear that the sheet guide unit is stopped in the middle of pushing and conveying the sheet to cause the part which is to be a fold line of the sheet to approach the folding roller pair and that a conveyance failure (jamming) is caused.

To solve such problems in the prior art, an object of the present invention is to provide a sheet folding apparatus capable of reducing the load acting on the sheet guide unit when the sheet is subjected to the folding processing.

Means for Solving the Problem

The present invention provides a sheet folding apparatus including a conveyance roller arranged on a conveyance path and configured to convey a sheet in a predetermined conveyance direction, a folding roller pair arranged on a downstream side of the conveyance roller in the conveyance direction and configured to nip a predetermined position of the sheet by a nip portion thereof and form a fold line, a pushing member configured to move to a pushing position to push the predetermined position of the sheet for the folding roller pair to nip the predetermined position, and a controller. Here, the controller controls operations of the conveyance roller, the folding roller pair, and the pushing member: so as to perform first folding processing for forming a first fold line owing to that the folding roller pair nips a first position of the sheet, which has a loop to be formed on an upstream side of the folding roller pair due to continuous conveyance of the sheet by the conveyance roller in a stopped state in which a front end of the sheet being conveyed from the conveyance roller is nipped by the folding roller pair at a nip portion thereof, as starting conveyance of the sheet from the stopped state while the pushing member is pushing the sheet and moving toward the pushing position; and so as to perform second folding processing for forming a second fold line, after the first folding processing, owing to that the folding roller pair nips a second position of the sheet with the loop formed.

Advantageous Effect of the Invention

According to the sheet folding apparatus of the present invention, since the sheet pushed by the pushing member toward the pushing position is conveyed at the same time by the folding roller pair, it is possible to reduce the load applied on the pushing member that pushes and moves the sheet.

MODE FOR CARRYING OUT THE INVENTION

Figure 1:
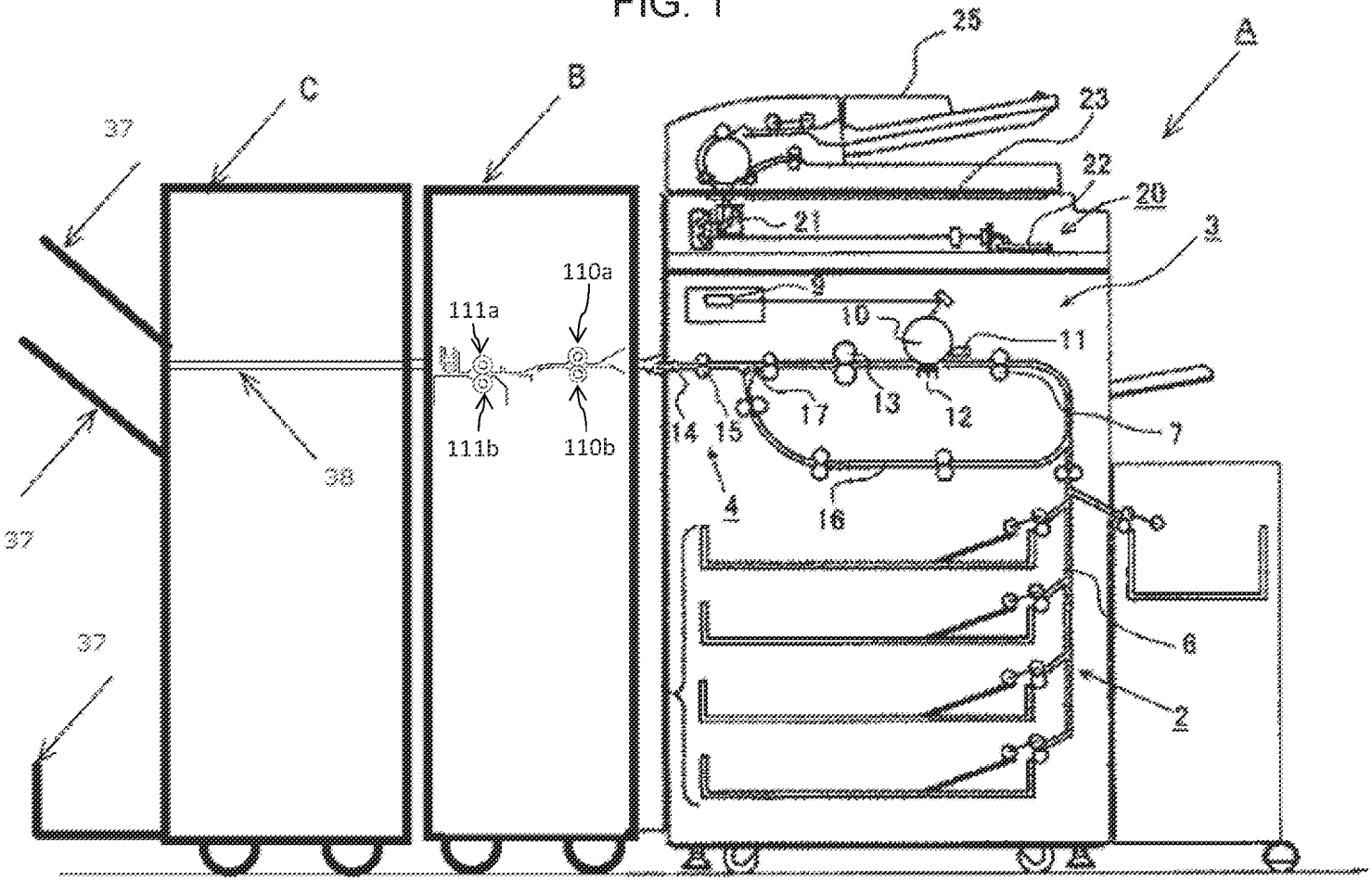
FIG. 1 is an overall configuration view of an image forming system according to a preferred embodiment of the present invention.

Hereinafter, preferred embodiments of a sheet folding apparatus according to the present invention will be described in detail. FIG. 1 shows the entire configuration of an image forming system including an image forming apparatus A which is a copying machine, a sheet folding apparatus B which is connected to a sheet discharge port of the image forming apparatus A, and a post-processing apparatus C which is connected to the downstream side of the sheet folding apparatus B.

[Image Forming Apparatus]

The image forming apparatus A of FIG. 1 is an electrostatic printing apparatus as described below, and various structures such as a copying machine, a printer, and a printing machine can be employed. The image forming apparatus A includes a sheet feeding unit 2, a printing unit 3, a sheet discharge unit 4, and a controller inside a casing. A plurality of cassettes corresponding to the sheet size are prepared in the sheet feeding unit 2, and the sheet having the size instructed by the controller is fed out to a sheet feeding path 6. Registration rollers 7 are arranged on the sheet feeding path 6, and after the sheet is aligned at the front end, the sheet is fed to the printing unit 3 on the downstream side at a predetermined timing.

An electrostatic drum 10 is arranged in the printing unit 3, and a printing head 9, a developing device 11, a transfer charger 12, and the like are arranged around the electrostatic drum 10. The printing head 9 is configured of, for example, a laser light emitting device, and forms an electrostatic latent image on the electrostatic drum 10, causes toner ink to adhere to the latent image with the developing device 11, and performs printing on the sheet with the transfer charger 12. The printed sheet is fixed by a fixing device 13 and is discharged to a sheet discharge path 17. A sheet discharge port 14 formed in the casing and sheet discharge rollers 15 are arranged in the sheet discharge unit 4. In FIG. 1, a reference numeral 16 denotes a circulation path, and after the sheet discharged from the sheet discharge path 17 is turned upside down in a switchback path, the sheet is fed to the registration rollers 7 again, and an image is formed on a back surface of the sheet. The printed sheet on which the image has been formed on one side or both sides in this manner is discharged from the sheet discharge port 14 by the sheet discharge rollers 15.

The image forming apparatus A includes, on the casing, a scanner unit 20 for optically reading a document image to be printed by the printing head 9. The scanner unit 20 includes, as is generally known, a platen 23 on which a document sheet is to be placed, a carriage 21 which scans the document image along the platen 23, and an optical reading unit (e.g., a CCD device) 22 which photoelectrically converts an optical image sent from the carriage 21. As shown in FIG. 1, a document feeding apparatus 25 which automatically feeds the document sheet to the platen 23 is arranged on the platen 23.

[Sheet Folding Apparatus]

The sheet folding apparatus B shown in FIG. 1 is connected to the sheet discharge port 14 of the image forming apparatus A, and performs folding processing on the sheet on which an image is formed by the image forming apparatus A and discharged. As shown in FIG. 1, the sheet folding apparatus B includes a conveyance roller pair 110 arranged on the upstream side along the conveyance path and a folding roller pair 111 arranged on the downstream side thereof.

Figure 2:
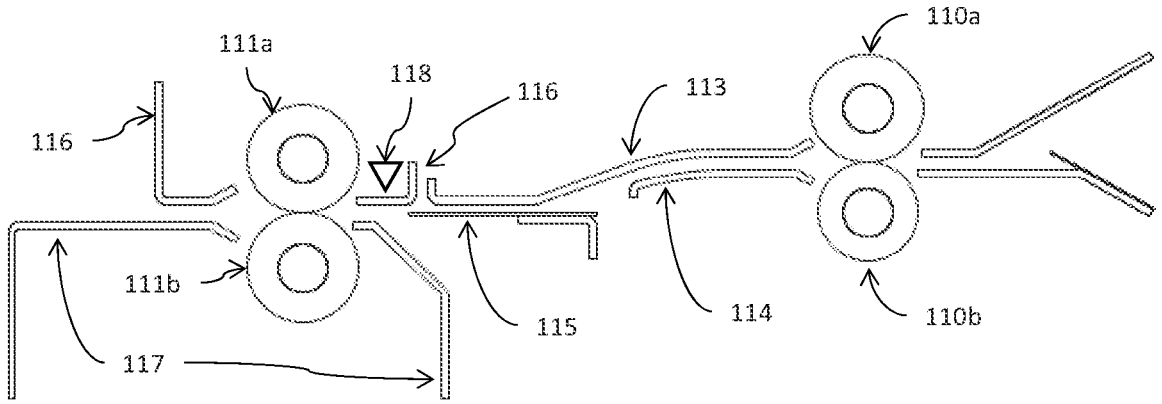
FIG. 2 is a schematic configuration view of a sheet folding apparatus of FIG. 1.

As shown in FIG. 2, the conveyance roller pair 110 includes an upper conveyance roller 110*a* and a lower conveyance roller 110*b* each formed of a rubber roller. The lower conveyance roller 110*b* is arranged so as to face the upper conveyance roller 110*a*, is pressed against the upper conveyance roller 110*a* by an elastic force of a spring (not shown), and is rotated in a driven manner. The upper conveyance roller 110*a* is connected to a conveyance drive motor of a conveyance drive mechanism (not shown), and is rotated by the rotation of the conveyance drive motor. The conveyance roller pair 110 is rotationally driven in the conveyance direction, and passes the sheet discharged and received from the image forming apparatus A on the upstream side to the downstream along the conveyance path.

The folding roller pair 111 includes an upper folding roller 111*a* and a lower folding roller 111*b* each formed of a rubber roller. The lower folding roller 111*b* is arranged so as to face the upper folding roller 111*a*, is pressed against the upper folding roller 111*a* by an elastic force of a spring (not shown), and is rotated in a driven manner. The upper folding roller 111*a* is connected to a folding drive motor of a folding drive mechanism (not shown), and is driven and rotated by the rotation of the conveyance drive motor in an appropriate manner for forward/reverse rotation, driving speed, and the like.

A sensor 118 is arranged above the upstream side of the folding roller pair 111. The sensor 118 can detect the conveyance timing of the front end of the sheet, thereby controlling the timing of stopping the sheet being conveyed along the conveyance path. Specifically, when the sensor 118 detects the conveyance timing of the front end of the sheet, and the front end of the sheet is determined to have reached the center of the nip portion of the folding roller pair 111, the subsequent rotation of the folding roller pair 111 is stopped.

An upper conveyance guide 113 is arranged between the conveyance roller pair 110 and the folding roller pair 111. The upper conveyance guide 113 is formed from a position right after the conveyance roller pair 110 to a position above a pushing plate (pushing member) 115 so as to guide the front end of the sheet from the conveyance roller pair 110 to the pushing plate 115. The upper conveyance guide 113 is for regulating the flow of the conveyed sheet, is arranged on the upper side of the conveyance face of the conveyance path, and has a shape bent downward toward the downstream side.

A lower conveyance guide 114 is arranged below the upper conveyance guide 113. The lower conveyance guide 114 is for regulating the flow of the conveyed sheet in cooperation with the upper conveyance guide 113, is arranged on the lower side of the conveyance path, and has a shape bent downward toward the downstream side in correspondence with the upper conveyance guide 113. A gap is formed on the downstream side of the lower conveyance guide 114, and the conveyance path is opened downward.

On the downstream side of the upper conveyance guide 113, an upper folding guide 116 is arranged above the conveyance path so as to extend over the upstream and downstream sides of the upper folding roller 111*a*. The upper folding guide 116 is formed so as to guide the front end and the sheet folding portion of the sheet conveyed along the conveyance path to the folding roller pair 111.

Below the conveyance path facing the upper folding guide 116, a lower folding guide 117 is arranged so as to extend over the upstream and downstream sides of the lower folding roller 111*b*. The lower folding guide 117 forms, at the upstream side of the folding roller pair 111, a horizontal surface parallel to the conveyance path in the conveyance direction and an inclined surface so as to guide the front end and the sheet folding part of the sheet conveyed along the conveyance path to the nip portion of the folding roller pair 111 in corporation with the upper folding guide 116.

The pushing plate 115 is arranged between the conveyance roller pair 110 and the folding roller pair 111 so as to be movable in parallel with the conveyance path at the upstream side of the folding roller pair 111. The pushing plate 115 is connected to a pushing plate drive motor of a pushing plate drive mechanism (not shown), and moves between the upstream side position at the lower side of the lower conveyance guide 114 and the downstream side position in front of the folding roller pair 111 along the conveyance direction by driving the pushing plate drive motor.

[Control Unit]

Figure 3:
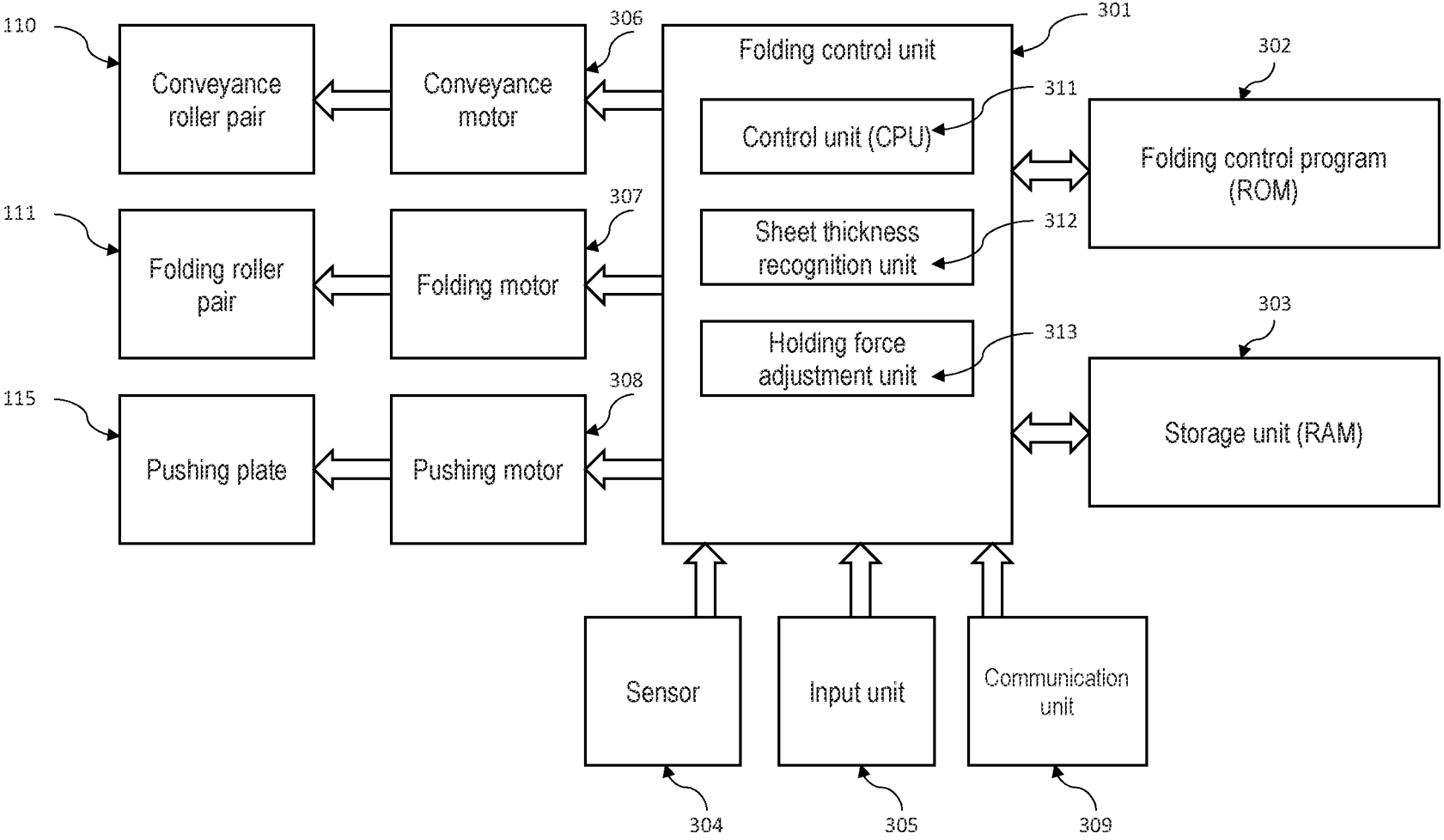
FIG. 3 is a block diagram showing the control configuration of the sheet folding apparatus.

FIG. 3 shows the configuration of the controller of the sheet folding apparatus B. The controller includes a folding control unit 301 for controlling folding processing of the sheet in the sheet folding apparatus B. The folding control unit 301 includes a control unit 311, a sheet thickness recognition unit 312, and a holding force adjustment unit 313, and is configured by, for example, a CPU. The folding control unit 301 loads a folding control program 302 stored in a ROM, and performs the folding processing while storing temporary information in a storage unit 303 as necessary.

The sensor 304 shown in FIG. 3 includes a sheet position detection unit (not shown). An input unit 305 includes an input interface such as a switch to enable an operation on the folding control unit 301. A communication unit 309 includes a serial communication interface for communicating with the image forming apparatus A or the like, such as a UART.

The folding control unit 301 can transmit signals to a conveyance motor 306, a folding motor 307, and a pushing motor 308 to control driving thereof. According to the control signals from the folding control unit 301, the conveyance motor 306 can drive the conveyance roller pair 110, the folding motor 307 can drive the folding roller pair 111, and the pushing motor 308 can drive the pushing plate 115, respectively.

The folding control unit 301 acquires information relating to the sheet to be conveyed, such as the stiffness and the thickness of the sheet discharged from the image forming apparatus A. Such information is input before the folding processing of the sheet discharged from the image forming apparatus A starts in the sheet folding apparatus B. The information is basically acquired by communication from the image forming apparatus A via the communication unit 309, but can also be acquired from a sensor or the like arranged in the sheet folding apparatus B.

[Folding Processing Operation]

The folding processing operation of the sheet by the folding control unit 301 will be described with reference to the flowchart of FIG. 4. In the folding processing operation, first folding processing of forming a first fold line of Z-folding on a sheet and second folding processing of forming a second fold line of Z-folding on the sheet are continuously performed in a series of operations.

First, the conveyance roller pair 110 is rotationally driven (step St01), and the sheet is conveyed to the folding roller pair 111. At this time, the pushing plate 115 is arranged so as to fill the gap between the lower conveyance guide 114 and the lower folding guide 117 and to guide the front end of the sheet to the lower folding guide 117.

Next, the folding roller pair 111 is rotationally driven (step St02) to nip the front end of the sheet. When the sensor 118 is turned on (Yes in step St03), after counting a predetermined value with the counter, it is recognized that the front end of the sheet is nipped by the folding roller pair 111, and folding roller pair 111 is stopped (step St04).

In order to form Z-folding on the sheet, the pushing plate 115 is moved in parallel from a position between the lower conveyance guide 114 and the lower folding guide 117 to a retracting position below the lower conveyance guide 114. Thus, the gap is formed between the lower conveyance guide 114 and the lower folding guide 117, and a loop space for creating a loop on the sheet is defined between the conveyance roller pair 110 and the folding roller pair 111 below the gap (step St05).

When the conveyance of the sheet by the conveyance roller pair 110 reaches a predetermined amount after the pushing plate 115 moves to the retracting position, the pushing plate 115 starts horizontal movement toward the folding roller pair 111 (step St06). The sheet is fed by the conveyance roller pair 110 while the folding roller pair 111 is kept stopped, thereby forming a loop shape that hangs down from the gap to the loop space. The pushing plate 115 is pushed in toward the nip portion of the folding roller pair 111 while pushing the loop-shaped sheet, so that the first fold line of the Z-folding is formed on the sheet.

Here, when the sheet thickness recognition unit 312 of the folding control unit 301 determines that the stiffness or the thickness of the sheet is larger than a predetermined value (Yes in step St07), the folding roller pair 111 is rotationally driven in the conveyance direction at the time when the pushing plate 115 advances to a predetermined position in front (i.e., at the upstream side) of a stopping position set near the nip portion of the folding roller pair 111 (step St08). As a result, the front end of the sheet nipped by the folding roller pair 111 is conveyed to the downstream side. The pushing plate 115 enters the nip portion of the folding roller pair 111 so as to be guided to the sheet conveyed to the downstream side by the folding roller pair 111.

Thus, by the auxiliary operation in which the sheet pushed by the pushing plate 115 is conveyed by the folding roller pair 111 at the same time, the load applied to the pushing plate 115 to push the sheet is reduced as compared with the case in which the auxiliary operation is not performed. Further, as a criterion for determining that the stiffness or thickness of the sheet is larger than a predetermined value, for example, it is possible to set a case in which the basis weight of the sheet exceeds 91 $g/m^2$.

When the fold line of the sheet formed by pushing the loop-shaped sheet as described above reaches the stopping position near the nip portion of the folding roller pair 111, the horizontal movement of the pushing plate 115 toward the nip portion of the folding roller pair 111 is stopped (step St09). At the same time, the rotational drive of the folding roller pair 111 is also stopped (step St10).

Thereafter, while the pushing plate 115 is kept stopped, the folding roller pair 111 is rotationally driven in the reverse direction, that is, the direction opposite to the conveyance direction (step St11). As a result, only the front end of the sheet is returned in the direction opposite to the conveyance direction without shifting the position of the fold line formed by the pushing plate 115 in the conveyance direction.

Next, when the front end of the sheet reaches a predetermined reverse rotation stopping position, the reverse rotation operation of the folding roller pair 111 is stopped (step St12). Thereafter, the folding roller pair 111 is rotationally driven in the forward direction, that is, in the conveyance direction again and the sheet is conveyed in the conveyance direction, thereby forming the second fold line of the Z-folding on the sheet (step St13). Thereafter, the pushing plate 115 is moved from the stopped state to the retracting position at the upstream side again (step St14), and the series of folding processing operations is completed.

In step St07, when it is determined that the stiffness or thickness of the sheet is equal to or smaller than the predetermined value (No in Step St07), when the pushing plate 115 reaches the stopping position near the folding roller pair 111, the folding roller pair 111 is rotatably driven in the conveyance direction to convey the sheet in the conveyance direction (Step St13). Thus, the position of the fold line of the sheet pushed by the pushing plate 115 is nipped by the folding roller pair 111 and the first fold line of the Z-folding is formed on the sheet. In this case, the folding roller pair 111 is rotationally driven in the conveyance direction when the pushing plate 115 has advanced to the predetermined position in front of the stopping position, and the auxiliary operation of conveying the sheet to the downstream side is not performed. Thereafter, the pushing plate 115 is moved from the stopping position to the retracting position at the upstream side again (step St14), and the series of folding processing operations is completed.

Next, the folding processing operation in the case in which the stiffness or thickness of the sheet is larger than the predetermined value will be described in detail with reference to FIGS. 5A to 7B. FIGS. 5A to 7B show a process in which the sheet folding apparatus B introduces the sheet from the image forming apparatus A and performs the folding processing while conveying the sheet in the order of steps.

Figure 5A:
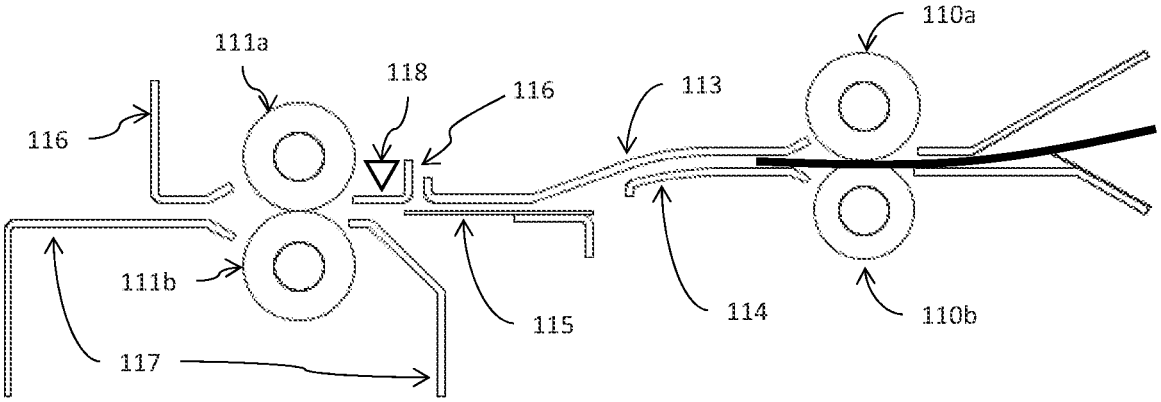
FIGS. 5A to 5C are views showing folding processing of the sheet folding apparatus in the order of steps.

First, as shown in FIG. 5A, owing to the rotational drive of the conveyance roller pair 110 in the conveyance direction, the sheet discharged from the image forming apparatus A on the upstream side passes through the conveyance roller pair 110 and is conveyed to the downstream side on the conveyance path between the upper conveyance guide 113 and the lower conveyance guide 114.

Figure 5B:
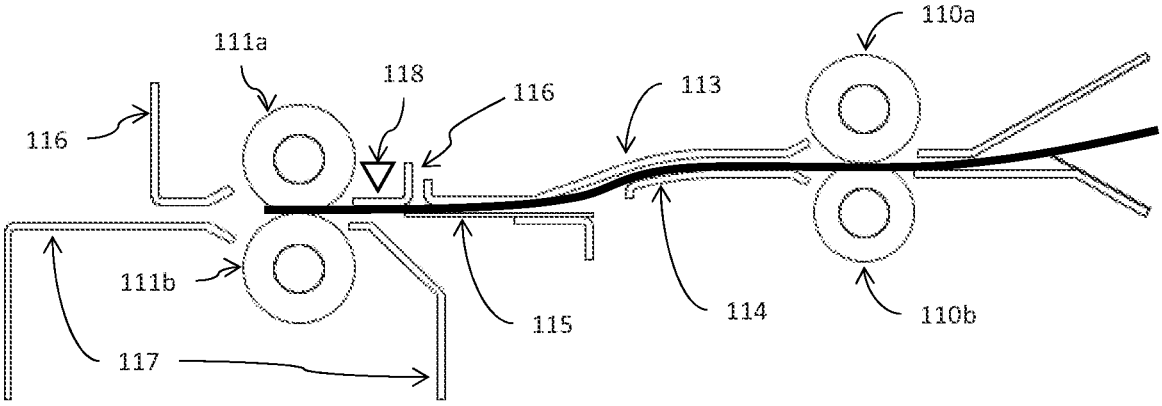

As shown in FIG. 5B, the sheet is conveyed through the conveyance path between the upper conveyance guide 113 and the pushing plate 115 and the conveyance path between the upper folding guide 116 and the lower folding guide 117. When the front end of the sheet is detected by the sensor 118 and further conveyed by a predetermined amount after being nipped by the folding roller pair 111, the rotational drive of the folding roller pair 111 is stopped.

Figure 5C:
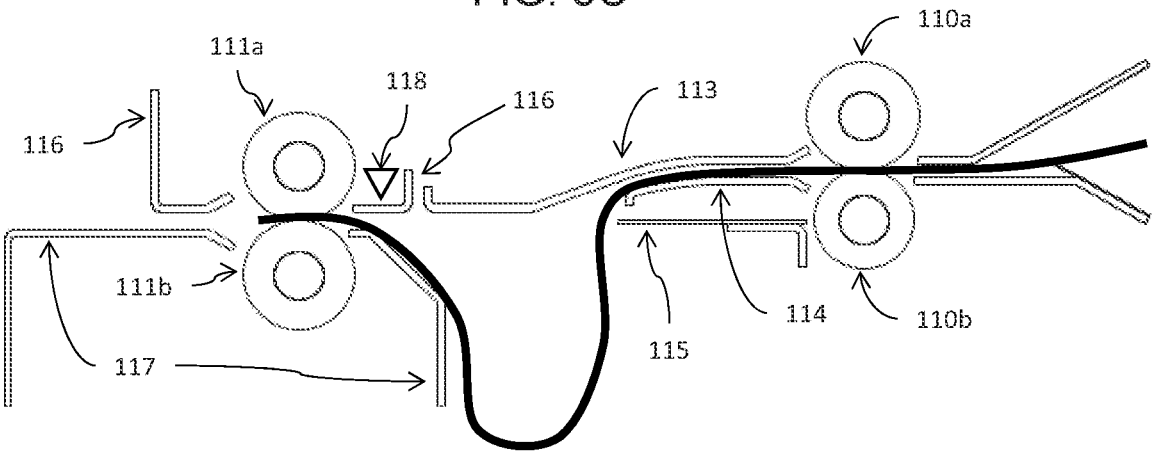

Next, as shown in FIG. 5C, in a state in which the front end of the sheet is nipped and held by the folding roller pair 111, the pushing plate 115 is moved to the retracting position to the upstream side, and the loop space for forming a loop on the sheet is defined on the lower side between the lower conveyance guide 114 and the lower folding guide 117. By continuing the rotational drive of the conveyance roller pair 110 even thereafter, the loop hanging down in the loop space is formed on the sheet.

Figure 6A:
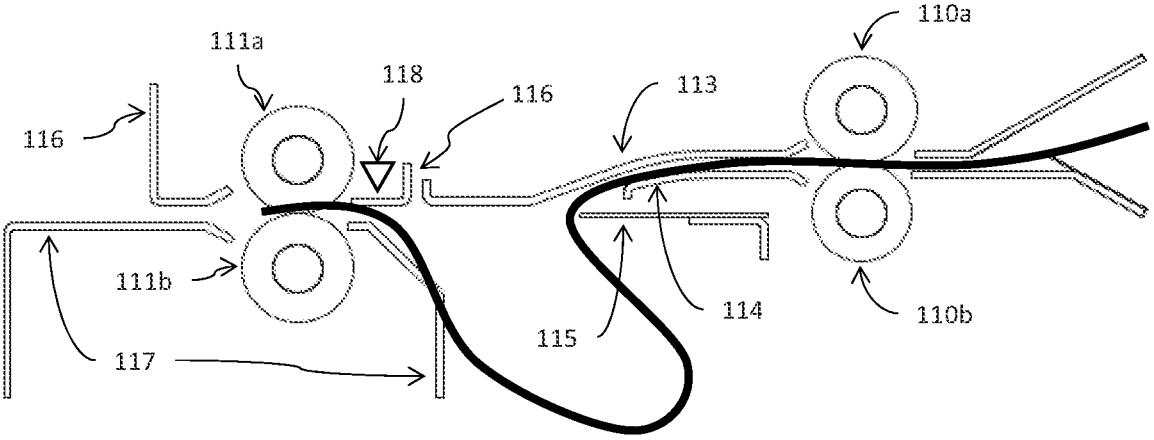
FIGS. 6A to 6C are views showing the folding processing following FIG. 5C in the order of steps.

As shown in FIG. 6A, the sheet is fed by the conveyance roller pair 110 by a predetermined amount in the conveyance direction to form the loop. Thereafter, the pushing plate 115 is horizontally moved from the retracting position to the downstream side.

Figure 6B:
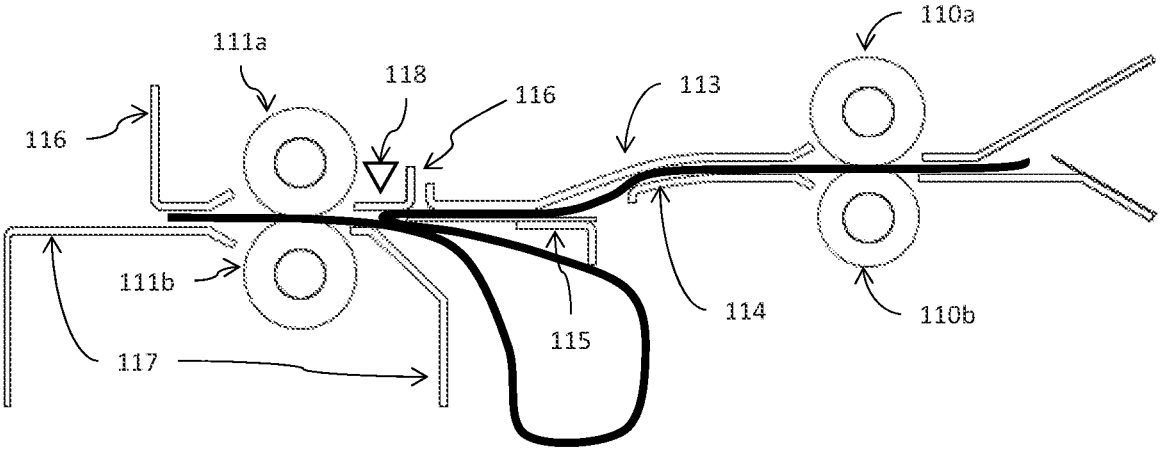

Next, as shown in FIG. 6B, when the pushing plate 115 reaches a predetermined position while moving toward the nip portion of the folding roller pair 111 during pushing the sheet, the folding roller pair 111 is rotationally driven in the conveyance direction. The timing for starting the rotational operation of the folding roller pair 111 is preferably set before the load received from the sheet by the pushing plate 115 which is moving toward the nip portion of the folding roller pair 111 becomes the largest.

As a result, the sheet is conveyed such that the front end thereof advances to the downstream side of the nip portion of the folding roller pair 111. At this time, as shown in FIG. 6B, the loop on the sheet is located below the pushing plate 115, and the lower part of the loop is conveyed to the downstream side by the folding roller pair 111 while the upper part of the loop is pushed by the pushing plate 115 and moves to the downstream side. Thus, since the pushing plate 115 enters the nip portion of the folding roller pair 111 so as to be guided by the sheet being conveyed to the downstream side by the folding roller pair 111 at the same time while pushing the sheet, the load applied to the pushing plate 115 is reduced by the pushing operation on the sheet. It is preferable that the speed at which the pushing plate 115 pushes and moves the sheet and the speed at which the folding roller pair 111 conveys the sheet are set to be the same.

Figure 6C:
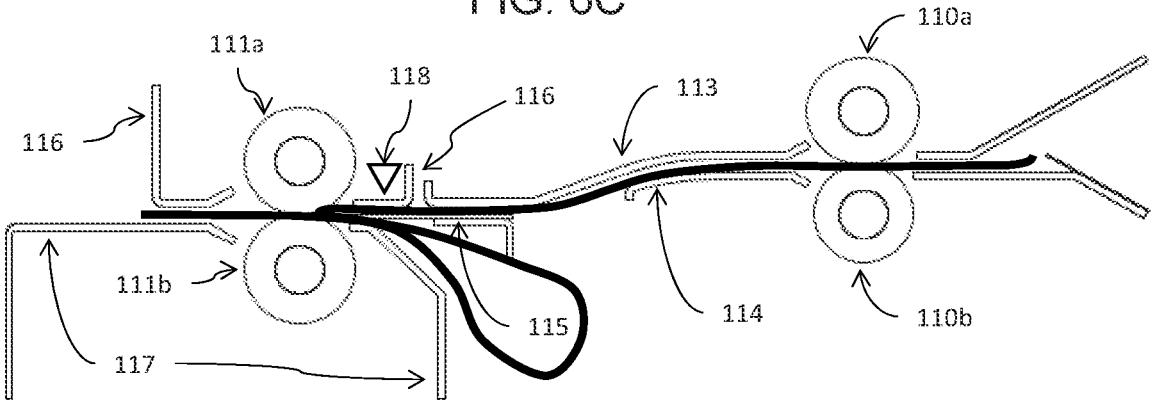

The sheet is pushed into a vertical gap between the upper folding guide 116 and the lower folding guide 117 by the pushing plate 115 in a state in which the part of the sheet against which the front end thereof abuts is folded, so that the first fold line of the Z-folding is formed on the sheet. As shown in FIG. 6C, when the first fold line of the sheet is pushed by the pushing plate 115 and reaches the vicinity of the nip portion of the folding roller pair 111, the operations of the pushing plate 115 and the folding roller pair 111 are stopped.

Figure 7A:
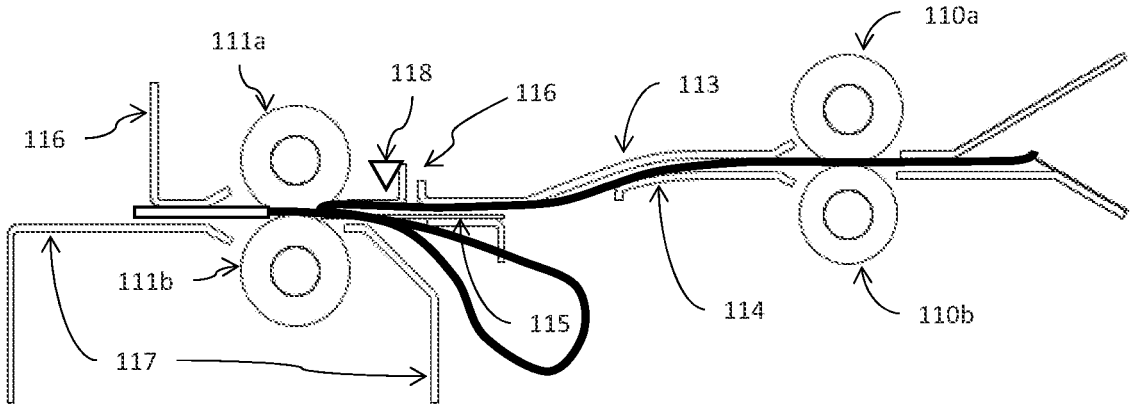
FIGS. 7A and 7B are views showing the folding processing following FIG. 6C in the order of steps.

Next, while the pushing plate 115 is kept stopped, the folding roller pair 111 is rotationally driven in the reverse direction, that is, the direction opposite to the conveyance direction. As a result, as shown in FIG. 7A, only the front end of the sheet can be returned in the direction opposite to the conveyance direction in a state in which the position of the first fold line is kept unchanged. When the front end of the sheet reaches a predetermined position downstream of the nip portion of the folding roller pair 111, the reverse rotation operation of the folding roller pair 111 is stopped.

In FIG. 7A, the reverse rotation operation of the folding roller pair 111 is stopped when the front end of the sheet reaches a position right in front of the nip portion at the downstream side of the folding roller pair 111. However, the timing of stopping the reverse rotation operation of the folding roller pair 111 is not limited thereto, and can be set to a different position as long as a state in which the front end of the sheet is at the downstream side of the nip portion and the nipped state is maintained.

Figure 7B:
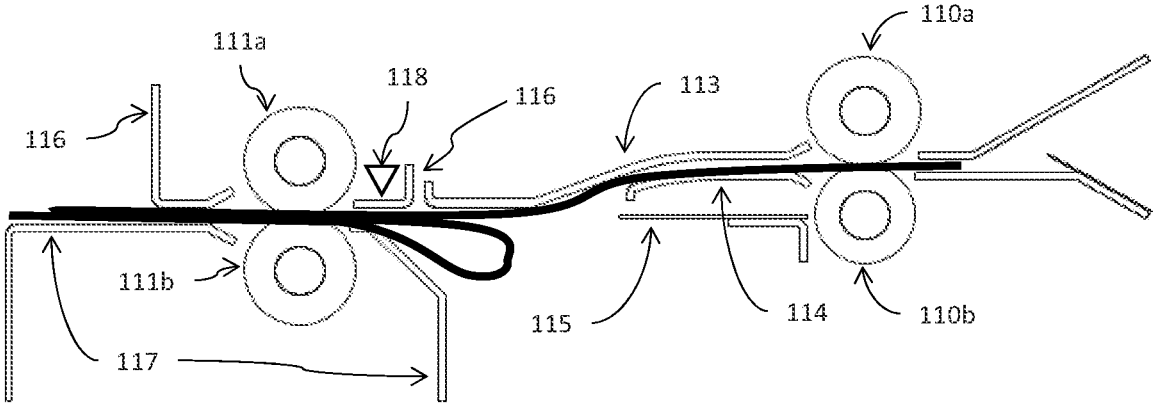

Thereafter, as shown in FIG. 7B, while moving the pushing plate 115 from the stopped state to the retracting position, the folding roller pair 111 is rotationally driven in the conveyance direction. Thus, the first fold line of the sheet is nipped and folded by the folding roller pair 111, and the first folding processing is completed.

Thereafter, the sheet is further conveyed in the conveyance direction, thereby a part forming a loop at the upstream side of the folding roller pair 111 is squeezed from the above and below between the upper folding guide 116 and the lower folding guide 117. Finally, the squeezed part of the sheet is overlapped with the rear end side of the sheet, nipped and folded by the folding roller pair 111, a second fold line is formed, and the second folding processing is completed.

[Control of Folding Processing Operation in Accordance with Thickness of Sheet]

Figure 4:
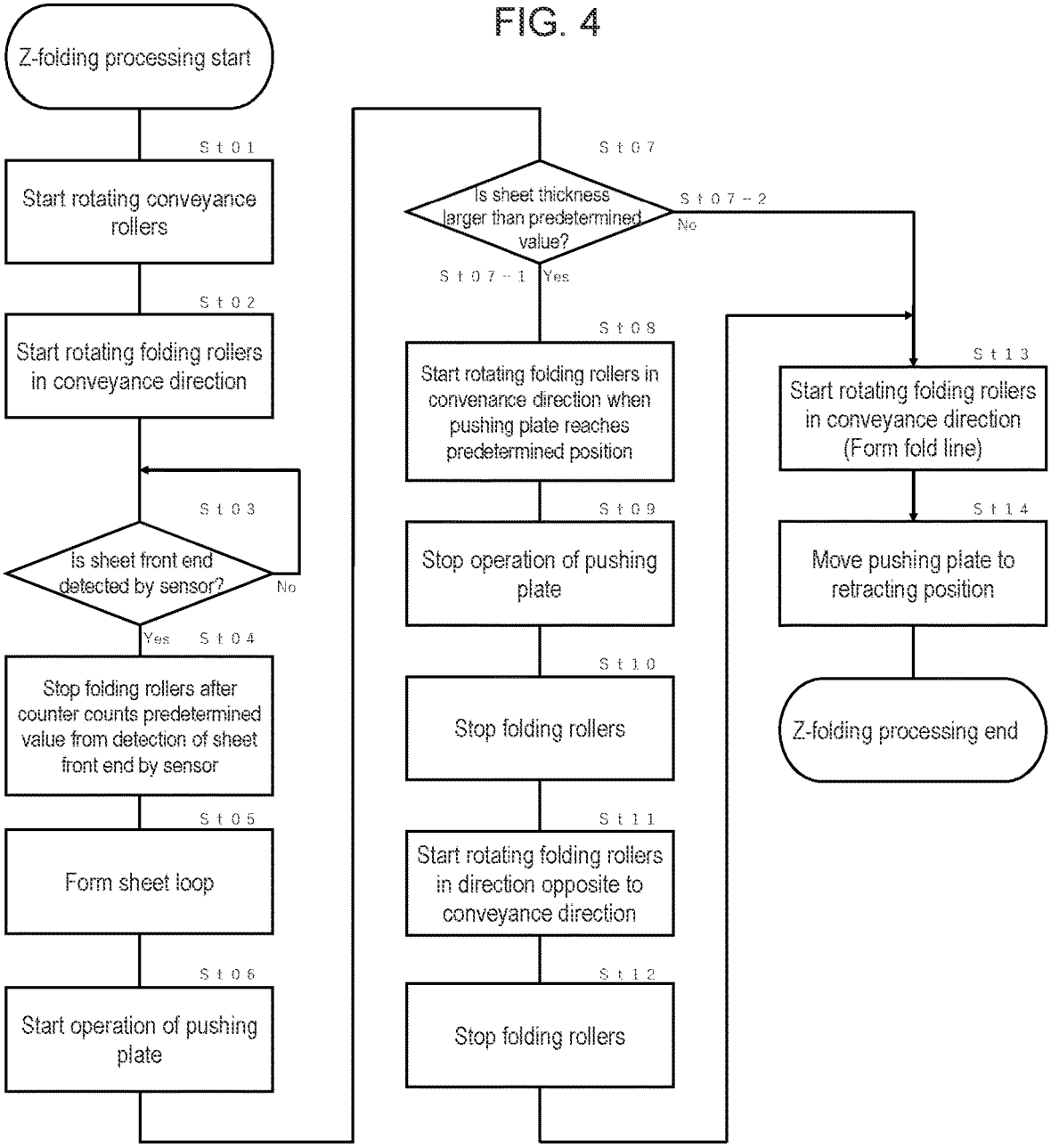
FIG. 4 is a flowchart for explaining a folding processing operation of the sheet folding apparatus.

Since the stiffness of the sheet is increased in accordance with the thickness thereof, even if the timing of starting the drive of the folding roller pair 111 is set early as described in relation to step St08 of FIG. 4, the upper surface of the sheet bent by the pushing of the front end of the pushing plate 115 may warp and come into contact with the lower surface of the upper folding guide 116 to cause a large resistance. As a result, there is a fear that the load applied to the pushing plate 115 cannot be sufficiently reduced. Therefore, it is preferable to change and adjust the starting timing of the drive of the folding roller pair 111 in step St08 of FIG. 4 in accordance with the thickness and stiffness of the sheet acquired from the communication unit 309.

Figure 8:
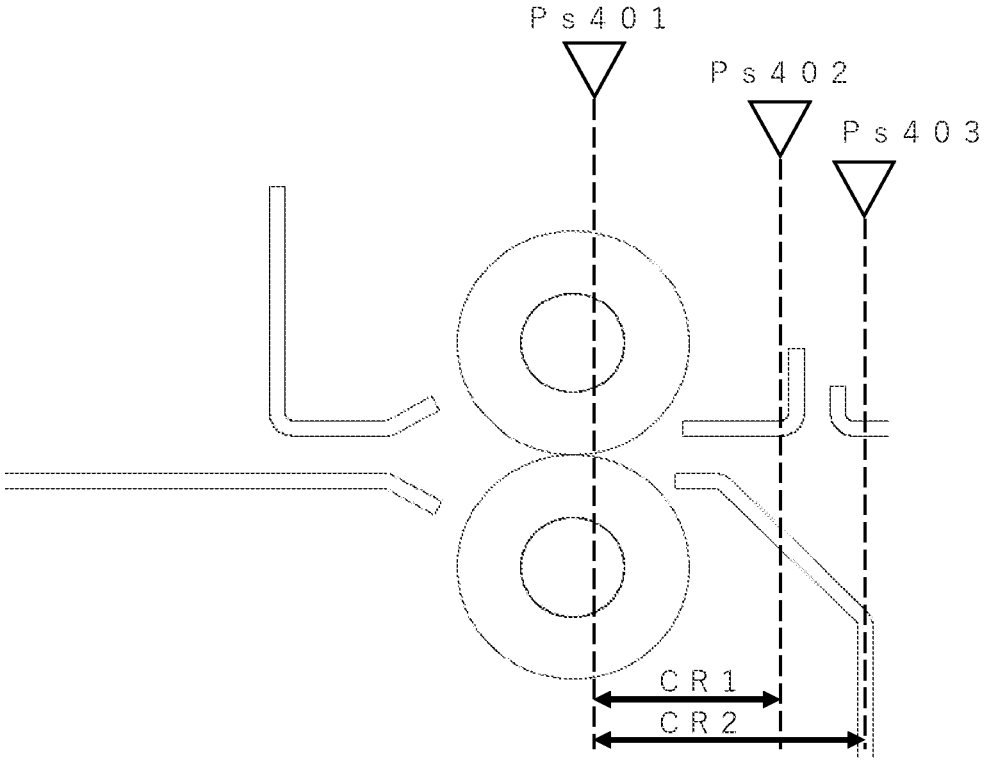
FIG. 8 is a view showing the folding processing according to a modification of the present invention.

Specifically, when the sheet thickness recognition unit 312 of the folding control unit 301 recognizes the thickness of the sheet to be introduced from the image forming apparatus A to be equal to or larger than a second predetermined thickness that is further thicker than the predetermined thickness, the rotational driving of the folding roller pair 111 in the conveyance direction is started when the front end of the pushing plate 115 advances to a second predetermined position (Ps403) shown in FIG. 8 in the conveyance direction. The predetermined thickness of the sheet is set to basis weight of the sheet of 91 $g/m^2$ in the embodiment described above, but here, the second predetermined thickness which is thicker than the predetermined thickness can be set to a criterion, for example, as a case of the basis weight of the sheet of 105 $g/m^2$.

FIG. 8 shows the position of the pushing plate 115 corresponding to the thickness of the sheet and the sheet conveyance amount (conveyance direction length) in the conveyance direction by the folding roller pair 111. In FIG. 8, a stopping position Ps401 of the pushing plate 115 is set near the nip portion of the folding roller pair 111. As shown in FIG. 8, when the thickness of the sheet is larger than the predetermined thickness and does not exceed the second predetermined thickness, a predetermined position Ps402 is set to the upstream side of the conveyance direction with respect to the stopping position Ps401. The second predetermined position Ps403 is set further upstream in the conveyance direction with respect to the predetermined position Ps402.

In the case that the thickness of the sheet is larger than the predetermined thickness, in accordance with the thickness, the rotational drive of the folding roller pair 111 is started when the front end of the pushing plate 115 reaches the predetermined position Ps402 or the second predetermined position Ps403, and the rotational drive of the folding roller pair 111 is stopped when the pushing plate 115 reaches the stopping position Ps401.

Figure 9A:
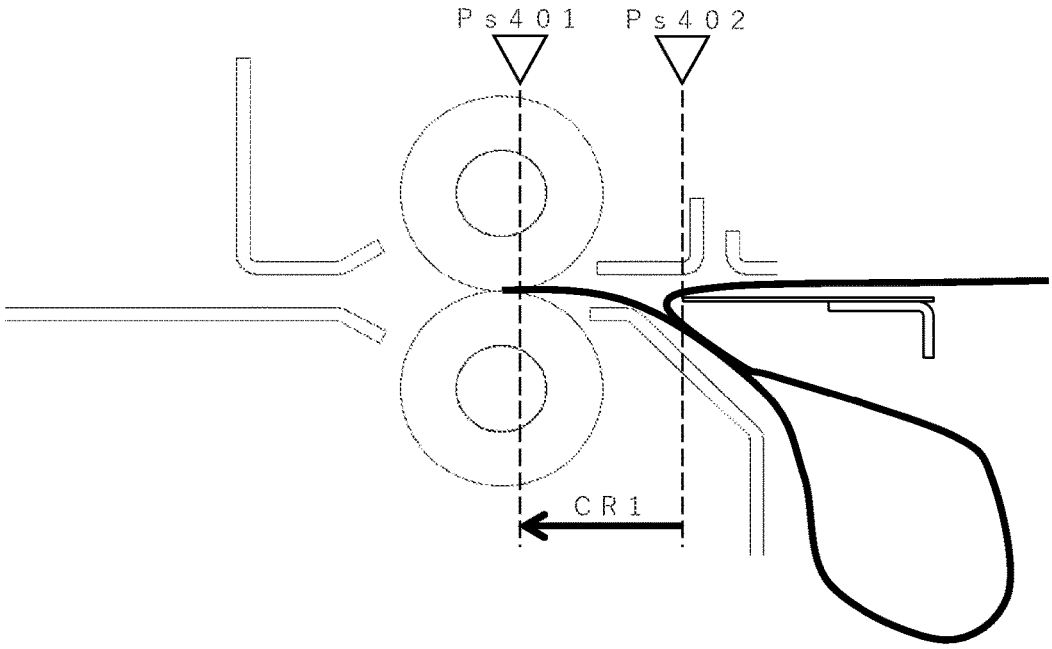
FIGS. 9A and 9B are views showing the folding processing according to another modification of the present invention.
Figure 9B:
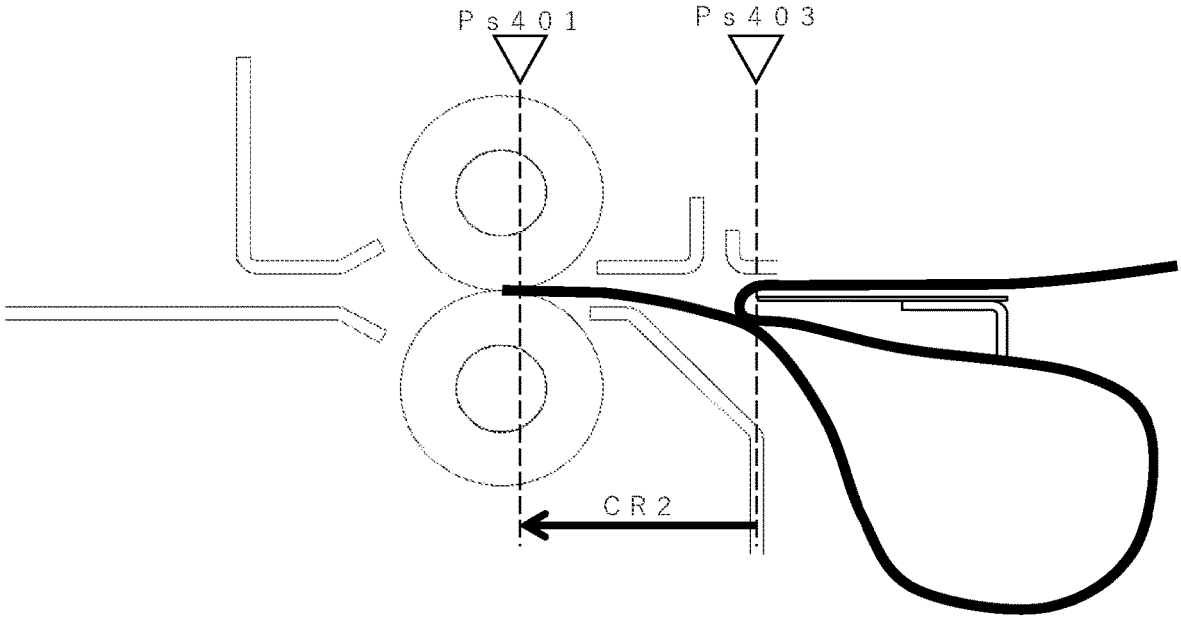

FIG. 9A shows a conveyance amount CR1 of the sheet at the time when the folding roller pair 111 is started to be driven when the front end of the pushing plate 115 reaches the predetermined position Ps402 in step St08 of FIG. 4. FIG. 9B shows a conveyance amount CR2 of the sheet at the time when the folding roller pair 111 is started to be driven when the front end of the pushing plate 115 reaches the predetermined position Ps403. As can be seen from the comparison between FIGS. 9A and 9B, when the starting timing of the drive of the folding roller pair 111 corresponds to the second predetermined position Ps403 (FIG. 9B), the conveyance amount CR2 of the sheet by the folding roller pair 111 is larger than the conveyance amount CR1 when the starting timing of the drive of the folding roller pair 111 corresponds to the predetermined position Ps402 (FIG. 9A).

When the rotational drive of the folding roller pair 111 is started before the fold line of the sheet formed and pushed out by the pushing of the pushing plate 115 reaches the nip portion of the folding roller pair 111, the front end of the sheet is conveyed to the downstream side with respect to the fold line of the sheet in the conveyance direction. Therefore, in order to return the front end of the sheet to the position of the fold line of the sheet in the conveyance direction, the folding roller pair 111 may be reversely driven in a state that the pushing plate 115 is stopped at the stopping position Ps401. Thus, the front end position of the sheet can be aligned with or brought close to the fold line position of the sheet.

Figure 10A:
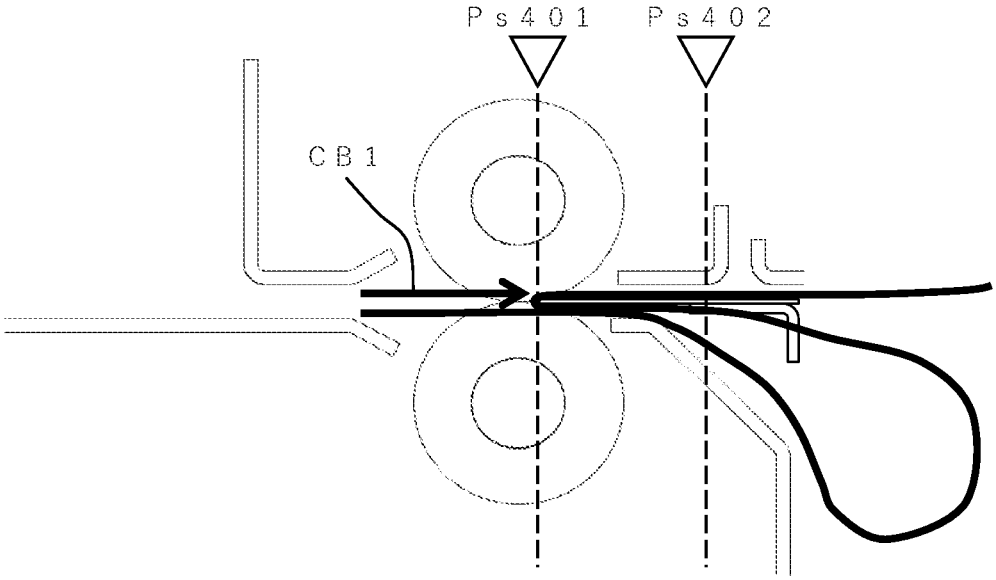
FIGS. 10A and 10B are views showing the folding processing according to another modification of the present invention.
Figure 10B:
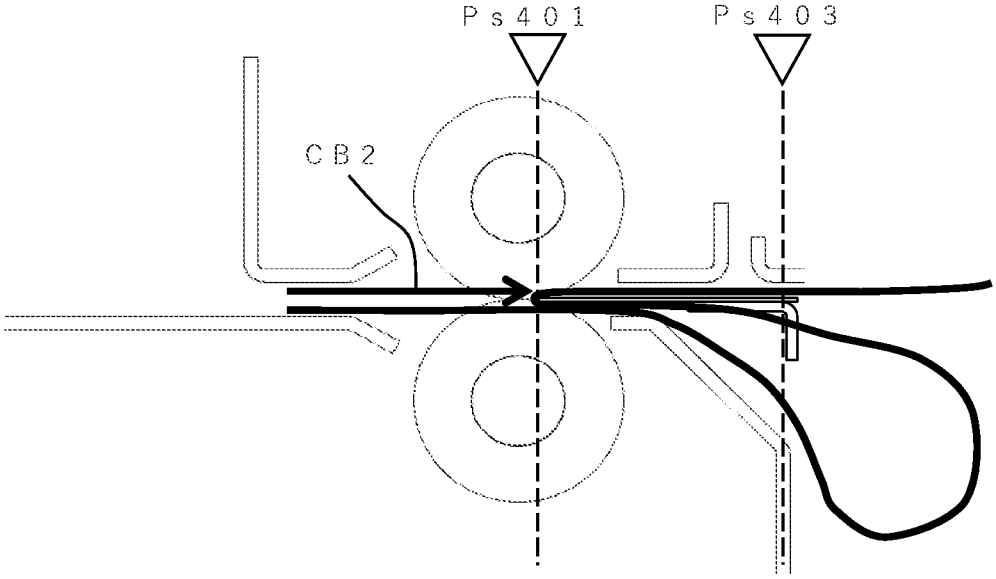

FIGS. 10A and 10B show the reverse-sheet conveyance amount in the opposite direction to the conveyance direction when the folding roller pair 111 is reversely driven in step St11 of FIG. 4. FIG. 10A shows a reverse-conveyance amount CB1 by the folding roller pair 111 when the starting timing of the drive of the folding roller pair 111 corresponds to the predetermined position Ps402 in step St08 of FIG. 4A. FIG. 10B shows a reverse-conveyance amount CB2 by the folding roller pair 111 when the starting timing of the drive of the folding roller pair 111 corresponds to the second predetermined position Ps403. As can be seen from the comparison between FIGS. 10A and 10B, in accordance with the conveyance amounts CR1, CR2 of the sheet in step St08, the reverse-conveyance amount by the folding roller pair 111 is larger when the starting timing of the drive of the folding roller pair 111 corresponds to second predetermined position Ps403 than that when the starting timing of the drive of the folding roller pair 111 corresponds to the predetermined position Ps402.

As described above in relation to step St11 of FIG. 4, when the folding roller pair 111 is reversely driven, the pushing plate 115 is held in the stopped state at the stopping position. Specifically, by applying a hold current to the pushing motor 308 by the holding force adjustment unit 313 of the folding control unit 301, it is possible to reliably hold the pushing plate 115 at the stopping position. The hold current is preferably set in accordance with various external forces acting on the pushing plate 115 in the stopped state at the stopping position. In the present embodiment, the hold current is output by the holding force adjustment unit 313 in accordance with the stiffness or thickness of the sheet acquired from the communication unit 309, and when the thickness of the sheet is recognized to be equal to or larger than the predetermined thickness or the second predetermined thickness, the holding current is output higher than when it recognized to be smaller than the predetermined thickness.

As described above, as a method of reducing the load applied to the pushing plate 115 when the folding processing is performed on the sheet having the stiffness or thickness larger than the predetermined value, the starting timing of the drive of the folding roller pair 111 is changed. As described above, when the folding processing is performed on the sheet having the stiffness or thickness larger than the predetermined value, in order to reduce the load for the pushing plate 115 to push the sheet, the folding roller pair 111 is rotationally driven in the conveyance direction when the pushing plate 115 reaches the predetermined position in the middle of moving toward the nip portion of the folding roller pair 111 while pushing the sheet. Therefore, the front end of the sheet advances to the downstream side of the nip portion of the folding roller pair 111, and it is necessary to rotationally drive the folding roller pair 111 in the reverse direction, that is, in the direction opposite to the conveyance direction while the pushing plate 115 is kept stopped at the position where the pushing plate 115 reaches the vicinity of the nip portion of the folding roller pair 111.

However, if the pushing plate 115 is stopped at the position being the same as in the case in which the sheet thickness recognition unit 312 of the folding control unit 301 determines that the stiffness or thickness of the sheet is equal to or smaller than the predetermined value, when the folding roller pair 111 is reversely rotated, there is no sufficient gap between the front end of the pushing plate 115 and the vicinity of the nip portion of the folding roller pair 111, a load is applied to the sheet being reversely conveyed, and there is a case in which the reverse conveyance cannot be performed. Therefore, the description will be provided below on the stopping position of the pushing plate 115 and control for stopping the pushing plate 115 when folding processing is performed on the sheet having the stiffness or thickness larger than the predetermined value.

Figure 11A:
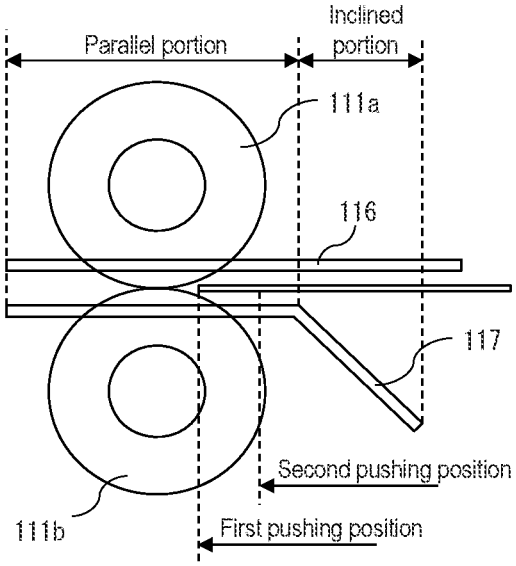
FIGS. 11A and 11B are views showing a stopping position of a pushing plate.
Figure 11B:
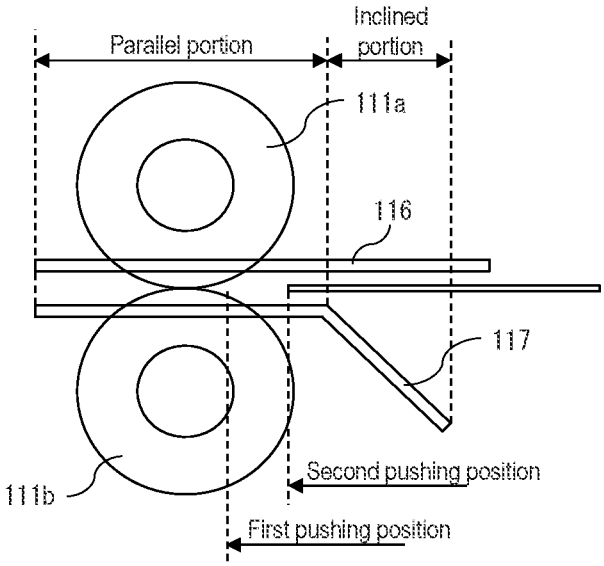

FIGS. 11A and 11B show, in the case that the sheet thickness recognition unit 312 of the folding control unit 301 determines that the stiffness or thickness of the sheet is equal to or smaller than the predetermined value, the position (first pushing position) of the pushing plate 115 where the pushing plate 115 pushes the fold line of the sheet to the vicinity of the nip portion and stops, and the position (second pushing position) of the pushing plate 115 where the pushing plate 115 pushes the sheet having the stiffness of thickness larger than the predetermined value and stops when the front end of the sheet is conveyed in the direction opposite to the conveyance direction by reverse rotation of the folding roller pair 111. As described above, below the conveyance path facing the upper folding guide 116, the lower folding guide 117 is arranged so as to extend over the upstream and downstream sides of the lower folding roller 111*b*. The lower folding guide 117 includes, at the upstream side of the folding roller pair 111, an inclined portion in which the width in the thickness direction of the sheet is gradually narrowed along the conveyance direction and a parallel portion in which the width in the thickness direction of the sheet is constant along the conveyance direction, so as to guide the front end and the sheet folding part of the sheet conveyed along the conveyance path to the nip portion of the folding roller pair 111 in corporation with the upper folding guide 116.

The first pushing position is the position where the front end of the pushing plate 115 is in the region of the parallel portion of the conveyance path and the fold line of the sheet can be delivered to the folding roller pair 111. When the pushing plate 115 is stopped at the first pushing position, the front end of the pushing plate 115 does not contact the nip portion of the folding roller pair 111. The second pushing position is the position where the front end of the pushing plate 115 is in the region of the parallel portion of the conveyance path and is located on the upstream side in the conveyance direction with respect to the first pushing position. The second pushing position can be appropriately set between the downstream side of the inclined portion of the conveyance path in the conveyance direction and the first pushing position. However, it is preferable that a gap in which the fold line of the sheet cannot be delivered to the folding roller pair 111 is secured between the front end of the pushing plate 115 and the nip portion of the folding roller pair 111. For example, as shown in FIGS. 11A and 11B, the front end of the pushing plate 115 may be stopped at the position corresponding to the outer periphery of the folding roller pair 111 when viewed in the conveyance direction, and the position may be set as the second pushing position. By stopping at this position, the sufficient gap is secured between the front end of the pushing plate 115 and the nip portion of the folding roller pair 111. Thus, it is possible to reduce the load applied when the folding roller pair 111 is reversely rotated and the sheet is conveyed in the direction opposite to the conveyance direction.

Next, description will be provided, with reference to FIGS. 12A to 12F, on a folding processing operation to temporarily stop the pushing plate 115 at the second pushing position in the case in which the stiffness or thickness of the sheet is larger than the predetermined value. FIGS. 12A to 12F show a process in which the sheet folding apparatus B introduces the sheet from the image forming apparatus A and performs the folding processing while conveying the sheet in the order of steps.

Figure 12A:
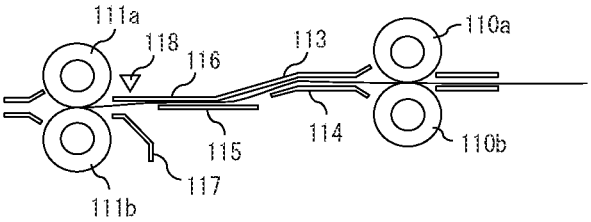
FIGS. 12A to 12F are views showing the folding processing of the sheet folding apparatus in the order of steps.

As shown in FIG. 12A, owing to the rotational drive of the conveyance roller pair 110 in the conveyance direction, the sheet discharged from the image forming apparatus A on the upstream side is conveyed to the downstream side on the conveyance path between the upper conveyance guide 113 and the lower conveyance guide 114. Further, the sheet is conveyed through the conveyance path, located at the downstream side of the above, between the upper conveyance guide 113 and the pushing plate 115 and the conveyance path between the upper folding guide 116 and the lower folding guide 117. When the front end of the sheet is detected by the sensor 118 and further conveyed by a predetermined amount after being nipped by the folding roller pair 111, the rotational drive of the folding roller pair 111 is stopped.

Figure 12B:
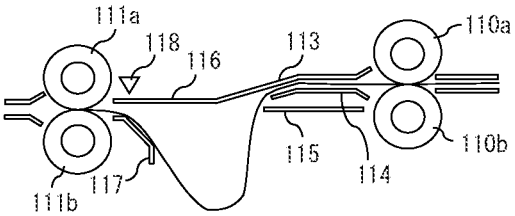

Next, as shown in FIG. 12B, in a state in which the front end of the sheet is nipped and held by the folding roller pair 111, the pushing plate 115 is moved to the retracting position to the upstream side, and the loop space for forming a loop on the sheet is defined on the lower side between the lower conveyance guide 114 and the lower folding guide 117. Thereafter, by rotationally driving the conveyance roller pair 110 in a state in which the front end of the sheet is nipped by the folding roller pair 111, the loop hanging down in the loop space is formed on the sheet.

Thereafter, the pushing plate 115 is moved from the retracting position to the downstream side in the same manner as described with reference to FIGS. 6A to 6C. As the pushing plate 115 moves, the front end of the pushing plate 115 moves toward the nip portion of the folding roller pair 111 while pushing the sheet. When the pushing plate 115 reaches a predetermined position in the middle of moving, the folding roller pair 111 is rotationally driven in the conveyance direction. The timing for starting the rotational operation of the folding roller pair 111 is preferably set to the timing before the load received from the sheet by the pushing plate 115 which is moving toward the nip portion of the folding roller pair 111 becomes the largest.

Figure 12C:
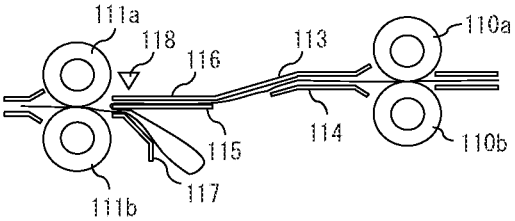

As a result, as shown in FIG. 12C, the sheet is conveyed such that the front end thereof advances to the downstream side of the nip portion of the folding roller pair 111. At this time, as shown in FIG. 12C, the loop on the sheet is located below the pushing plate 115, and the lower part of the loop is conveyed to the downstream side by the folding roller pair 111 while the upper part of the loop is pushed by the pushing plate 115 and moves to the downstream side. Thus, since the pushing plate 115 enters the nip portion of the folding roller pair 111 so as to be guided by the sheet being conveyed to the downstream side by the folding roller pair 111 at the same time while pushing the sheet, the load applied to the pushing plate 115 is reduced by the pushing operation of the sheet. It is preferable that the speed at which the pushing plate 115 pushes and moves the sheet and the speed at which the folding roller pair 111 conveys the sheet are set to be the same.

The sheet is pushed into the parallel portion between the upper folding guide 116 and the lower folding guide 117 by the pushing plate 115 in a state in which the part of the sheet against which the front end thereof abuts is folded, so that the first fold line of the Z-folding is formed on the sheet. When the first fold line of the sheet is pushed by the pushing plate 115 and reaches the second pushing position, the operations of the pushing plate 115 and the folding roller pair 111 are stopped.

Figure 12D:
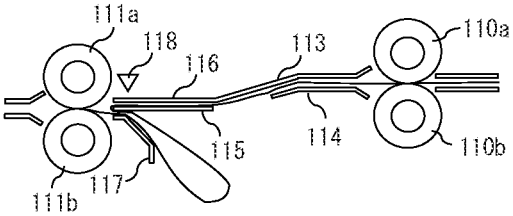

Next, while the pushing plate 115 is stopped, the folding roller pair 111 is rotationally driven in the reverse direction, that is, the direction opposite to the conveyance direction. As a result, as shown in FIG. 12D, only the front end of the sheet can be returned in the direction opposite to the conveyance direction in a state in which the position of the first fold line is kept unchanged. Moreover, since the pushing plate 115 is stopped in a state of being stopped at the second pushing position, a predetermined distance is secured between the front end of the pushing plate 115 and the nip portion of the folding roller pair 111, and when returning only the front end of the sheet in the direction opposite to the conveyance direction, the load applied on the sheet can be reduced. When the front end of the sheet reaches the predetermined position downstream of the nip portion of the folding roller pair 111, the reverse rotation operation of the folding roller pair 111 is stopped.

In FIG. 12D, the reverse rotation operation of the folding roller pair 111 is stopped when the front end of the sheet reaches the nip portion of the folding roller pair 111. However, the timing of stopping the reverse rotation operation of the folding roller pair 111 is not limited thereto, and can be set to a different position as long as a state in which the front end of the sheet is at the downstream side of the nip portion and the nipped state is maintained.

Figure 12E:
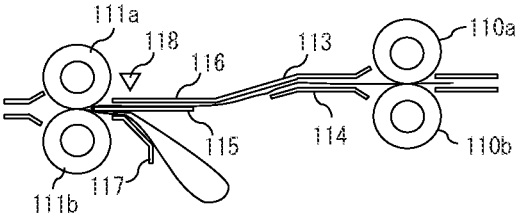
Figure 12F:
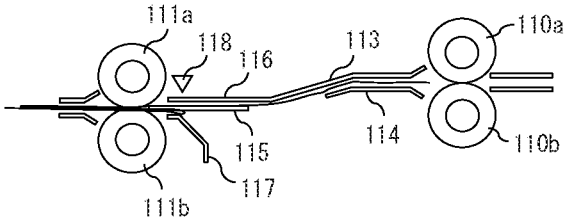

Thereafter, as shown in FIG. 12E, at the same time as driving the conveyance roller pair 110 in the conveyance direction, the pushing plate 115 is moved from the second pushing position to the first pushing position. Accordingly, the first fold line of the sheet approaches the vicinity of the nip portion of the folding roller pair 111, and it becomes possible to deliver the first fold line of the sheet to the folding roller pair 111. Thereafter, as shown in FIG. 12F, by rotating the folding roller pair 111 in the forward rotation, that is, in the conveyance direction, the first fold line of the sheet is nipped and folded by the folding roller pair 111, and the first folding processing is completed.

Thereafter, the sheet is further conveyed in the conveyance direction, thereby a part forming a loop at the upstream side of the folding roller pair 111 is squeezed from the above and below between the upper folding guide 116 and the lower folding guide 117. Finally, the squeezed part of the sheet is overlapped with the rear end side of the sheet, nipped and folded by the folding roller pair 111, the second fold line is formed, and the second folding processing is completed.

[Folding Processing Operation]

Figure 13:
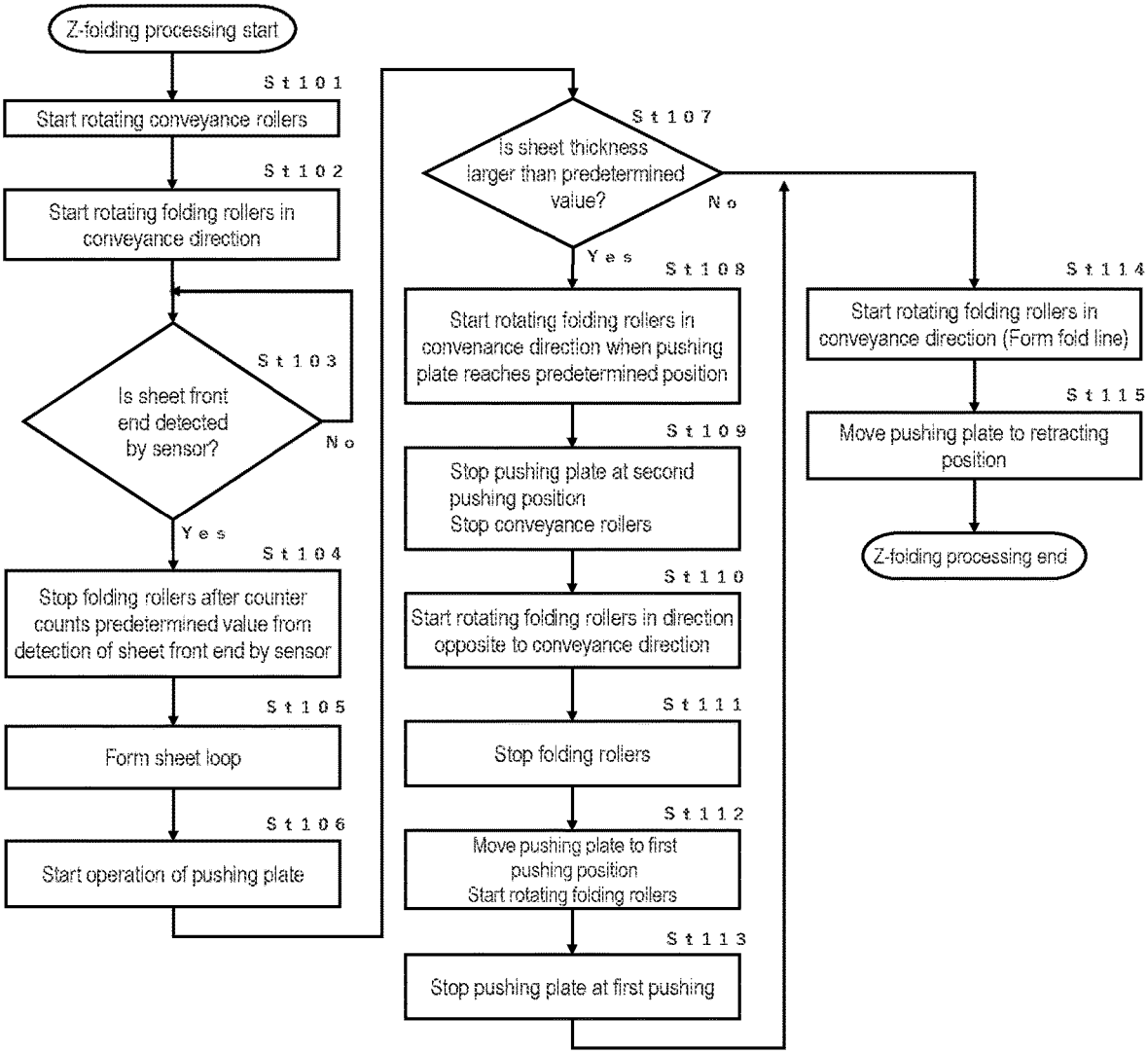
FIG. 13 is a flowchart for explaining the folding processing operation of the sheet folding apparatus.

Description will be provided, with reference to the flowchart of FIG. 13, on the folding processing operation to temporarily stop the pushing plate 115 at the second pushing position in the case in which the stiffness or thickness of the sheet is larger than the predetermined value. In the folding processing operation, the first folding processing of forming the first fold line of Z-folding on the sheet and the second folding processing of forming the second fold line of Z-folding are continuously performed in a series of operations.

First, the conveyance roller pair 110 is rotationally driven (step St101), and the sheet is conveyed to the folding roller pair 111. At this time, the pushing plate 115 is arranged so as to fill the gap between the lower conveyance guide 114 and the lower folding guide 117 and to guide the front end of the sheet to the lower folding guide 117.

Next, the folding roller pair 111 is rotationally driven in the conveyance direction (step St102). When the sensor 118 is turned on (Yes in step St103), after counting a predetermined value with the counter, it is recognized that the front end of the sheet is nipped by the folding roller pair 111, and folding roller pair 111 is stopped (step St104).

In order to form the Z-folding on the sheet, the pushing plate 115 is moved in parallel from the position between the lower conveyance guide 114 and the lower folding guide 117 to the retracting position below the lower conveyance guide 114. Thus, the gap is formed between the lower conveyance guide 114 and the lower folding guide 117, and the loop space for creating a loop on the sheet is defined between the conveyance roller pair 110 and the folding roller pair 111 below the gap (step St105).

When the conveyance of the sheet by the conveyance roller pair 110 reaches a predetermined amount after the pushing plate 115 moves to the retracting position, the pushing plate 115 starts horizontal movement toward the folding roller pair 111 (step St106). The sheet is fed by the conveyance roller pair 110 while the folding roller pair 111 is stopped, thereby forming a loop shape that hangs down from the gap to the loop space. The pushing plate 115 is pushed toward the nip portion of the folding roller pair 111 while pushing the loop-shaped sheet, so that the first fold line of the Z-folding is formed on the sheet.

Here, when the sheet thickness recognition unit 312 of the folding control unit 301 determines that the stiffness or the thickness of the sheet is larger than a predetermined value (Yes in step St107), the folding roller pair 111 is rotationally driven in the conveyance direction when the pushing plate 115 advances to a predetermined position in front (i.e., at the upstream side) of a stopping position set near the nip portion of the folding roller pair 111 (step St108). As a result, the front end of the sheet nipped by the folding roller pair 111 is conveyed to the downstream side.

Thus, by the auxiliary operation in which the sheet pushed by the pushing plate 115 is conveyed by the folding roller pair 111 at the same time, the load applied to the pushing plate 115 by the pushing of the sheet is reduced as compared with the case in which the auxiliary operation is not performed. Further, as a criterion for determining that the stiffness or thickness of the sheet is larger than a predetermined value, for example, it is possible to set a case in which the basis weight of the sheet exceeds 91 $g/m^2$.

When the first fold line of the loop-shaped sheet is pushed by the pushing plate 115 and the front end of the pushing plate 115 reaches the second pushing position, the operation of the pushing plate 115 toward the nip portion of the folding roller pair 111 is stopped. At the same time, the rotational drive of the folding roller pair 111 and the conveyance roller pair 110 is also stopped (step St109).

Thereafter, while the pushing plate 115 is stopped, the folding roller pair 111 is rotationally driven in the reverse direction, that is, the direction opposite to the conveyance direction (step St110). As a result, only the front end of the sheet is returned in the direction opposite to the conveyance direction without shifting the position of the first fold line pushed by the pushing plate 115 in the direction opposite to the conveyance direction.

Next, when the front end of the sheet reaches a predetermined reverse rotation stopping position, the reverse rotation operation of the folding roller pair 111 is stopped (step St111). Thereafter, the pushing plate 115 starts to move from the second pushing position to the first pushing position. At the same time, the conveyance roller pair 110 is rotationally driven in the conveyance direction (step St112). When the front end of the pushing plate 115 reaches the first pushing position, the rotational drive is stopped (step St113). The folding roller pair 111 is rotationally driven in the forward direction, that is, in the conveyance direction again and the sheet is conveyed in the conveyance direction, thereby forming the second fold line of the Z-folding on the sheet (step St114). Thereafter, the pushing plate 115 is moved from the stopped state to the retracting position at the upstream side again (step St115), and the series of folding processing operations is completed.

In step St107, when it is determined that the stiffness or thickness of the sheet is equal to or smaller than the predetermined value (No in Step St107), when the pushing plate 115 reaches the first pushing position near the folding roller pair 111, the folding roller pair 111 is rotatably driven in the conveyance direction to convey the sheet in the conveyance direction (Step St114). Thus, the position of the fold line of the sheet pushed by the pushing plate 115 is nipped by the folding roller pair 111 and the first fold line of the Z-folding is formed on the sheet. In this case, the folding roller pair 111 is rotationally driven in the conveyance direction when the pushing plate 115 has advanced to the predetermined position in front of the first pushing position, and the auxiliary operation of conveying the sheet to the downstream side is not performed. Thereafter, the pushing plate 115 is moved from the first pushing position to the retracting position at the upstream side again (step St115), and the series of folding processing operations is completed.

In the series of the folding processing operations described above, the front end of the pushing plate 115 is temporarily stopped at the second pushing position, and then moved to the first pushing position. However, the pushing plate 115 is not limited to moving in this order, and may move to the first pushing position and stop, and move to the second pushing position at a timing at which the folding roller pair 111 is reversely rotated to return the front end of the sheet. Owing to that the front end of the pushing plate 115 moves to the second pushing position, a predetermined distance is secured between the front end of the pushing plate 115 and the nip portion of the folding roller pair 111, and when returning only the front end of the sheet in the direction opposite to the conveyance direction, the load applied on the sheet can be reduced.

Further, description will be provided on a case in which the sheet thickness recognition unit 312 of the folding control unit 301 determines that the stiffness or thickness of the sheet is further larger than the predetermined value. In this case, as a criterion for determining that the stiffness or thickness of the sheet is further larger than the predetermined value, for example, it is possible to set a case in which the basis weight of the sheet exceeds 105 g/m$^2$. When it is determined that the stiffness or thickness of the sheet is further larger than the predetermined value, the pushing plate 115 is not moved in step St112, and only the conveyance roller pair 110 may be started to rotate in the conveyance direction and the first fold line may be conveyed toward the nip portion of the folding roller pair 111. When the stiffness or thickness of the sheet is further larger than the predetermined value, the stiffness of the sheet is high, and the sheet can be conveyed only by the conveyance roller pair 110 without using the pushing plate 115, and the first fold line can be conveyed toward the folding roller pair 111 without moving the pushing plate 115.

Further, when the sheet thickness recognition unit 312 of the folding control unit 301 determines that the stiffness or thickness of the sheet is further larger than the predetermined value, the conveyance roller pair 110 may be started to rotate in the conveyance direction before the pushing plate 115 starts to move in step St112. When the stiffness or thickness of the sheet is further larger than the predetermined value, the stiffness of the sheet is high, and the sheet can be conveyed only by the conveyance roller pair 110. Accordingly, the load applied at the time of initial movement of the pushing plate 115 temporarily stopped at the parallel portion of the conveyance path pushing the first fold line can be reduced.

Further, when the sheet thickness recognition unit 312 of the folding control unit 301 determines that the stiffness or thickness of the sheet is further larger than the predetermined value, while stopping the pushing plate 115 in step St110, the hold current for holding the motor for driving the pushing plate 115 may be increased to increase the holding force to stop the pushing plate 115 when the folding roller pair 111 is reversely rotated, that is, rotationally driven in the direction opposite to the conveyance direction. Thus, it is possible to hold the pushing plate 115 at the second pushing position even in a case in which the folding roller pair 111 is reversely rotated and the sheet is conveyed in the direction opposite to the conveyance direction.

[Post-Processing Apparatus]

The post-processing apparatus C is provided with a post-processing path 38 continuous on the downstream side of the lower folding guide 117 of the sheet folding apparatus B. Post-processing devices such as a staple unit and an alignment unit are arranged on the post-processing path 38, and sheets from the image forming apparatus A are received from the sheet folding apparatus B via the lower folding guide 117, subjected to staple processing, alignment processing, and the like, and discharged to a sheet discharge tray 37. When such post-processing is not required to be performed, the sheet conveyed from the image forming apparatus A via the sheet folding apparatus B passes through the post-processing apparatus C as it is and is stored in the sheet discharge tray 37.

Although preferred embodiments of the present invention have been described above, the present invention is not limited to these embodiments, and can be appropriately modified within the scope not departing from the technical scope of the present invention. In the above description, the sheet folding apparatus has been described as an independent apparatus separate from the image forming apparatus, but a series of configurations for realizing the sheet folding apparatus of the present invention may be configured as a part of the image forming apparatus or may be configured as a part of the post-processing apparatus.

Here, the present application claims priority from Japanese Patent Application No. 2020-214610 and Japanese Patent Application No. 2021-191712 incorporated herein by reference.

The invention claimed is:

1. A sheet folding apparatus, comprising:

a pair of conveyance rollers configured to convey a sheet;

a pair of folding rollers arranged on a downstream side with respect to the pair of conveyance rollers in a conveyance direction of the pair of conveyance rollers, and configured to form first and second fold lines on the sheet by nipping the sheet at a nip portion and convey the sheet by rotation in a predetermined direction;

a pair of folding guides provided between the pair of conveyance rollers and the pair of folding rollers in the conveyance direction, and guiding the sheet conveyed by the pair of conveyance rollers to the nip portion; and a pushing member configured to move to a first position guiding the sheet conveyed by the pair of conveyance rollers to the pair of folding guides, a second position located at an upstream side in the conveying direction more than the first position, and a third position located at a downstream side in the conveying direction more than the first position, wherein in a case the pushing member is located in the second position, the pair of folding rollers nips the sheet and stops rotation, the pair of conveyance rollers continuously conveys the sheet to form a loop on the sheet, and the loop is formed to hang down between the pair of folding rollers and the pair of conveyance rollers, wherein in a case the pushing member moving in a direction from the second position to the third position, the pushing member pushes a part of the sheet toward between the pair of folding guides, wherein in a case the pushing member moves from the second position to the third position, the pair of folding rollers restarts rotation in the predetermined direction from a stopped state before the pushing member arrives at the third position, wherein the pair of folding rollers rotates in the predetermined direction to convey the sheet so that the first fold line is formed on a part of the sheet pushed between the pair of guide members by the pushing member, and wherein the sheet on which the first fold line is formed is further transferred to form the second fold line.

2. The sheet folding apparatus according to claim 1, further comprising a sheet thickness acquiring unit configured to acquire a thickness of the sheet conveyed by the conveyance roller, wherein a time from a state where the pair of folding rollers stops to restart rotation to the predetermined direction when the sheet thickness acquiring unit acquires that the thickness of the sheet is larger than a predetermined thickness is shorter than a time from a state where the pair of folding rollers stops to restart rotation to the predetermined direction when the sheet thickness acquiring unit acquires that the thickness of the sheet is thinner than a predetermined thickness.

3. The sheet folding apparatus according to claim 1, wherein the pushing member stops in a case the pushing member arrives at the third position, and wherein in a state where the pushing member stops in the third position, the pair of folding rollers rotates in a reverse direction with respect to the predetermined direction, and moves a leading portion of the sheet in the conveyance direction for a predetermined amount in a reverse direction relative to the conveyance direction.

4. The sheet folding apparatus according to claim 2, wherein the pushing member stops in a case the pushing member arrives at the third position, wherein in a state where the pushing member stops in the third position, the pair of folding rollers rotates in a reverse direction with respect to the predetermined direction, and moves a leading portion of the sheet in the conveyance direction for a predetermined amount in a reverse direction relative to the conveyance direction, and wherein a rotation amount in the reverse direction of the pair of folding rollers in a case the sheet thickness acquiring unit acquires that the thickness of the sheet is larger than a predetermined thickness, is greater than a rotation amount of the pair of folding rollers in the reverse direction in a case the sheet thickness acquiring unit acquires that the thickness of the sheet is thinner than a predetermined thickness.

5. The sheet folding apparatus according to claim 1, further comprising a sheet thickness acquiring unit configured to acquire a thickness of the sheet, wherein in a case the sheet thickness acquiring unit acquires that the thickness of the sheet is larger than a predetermined thickness, the pair of folding rollers restarts rotation to the predetermined direction from a stop state before the pushing member arrives at the third position, and wherein in a case the sheet thickness acquiring unit acquires that the thickness of the sheet is thinner than a predetermined thickness, the pair of folding rollers restarts rotation to the predetermined direction from a stop state after the pushing member arrives at the third position.

6. The sheet folding apparatus according to claim 1, further comprising:

a holding unit configured to generate a holding force for holding the pushing member in a state of being stopped at the third position.

7. The sheet folding apparatus according to claim 6, further comprising:

a sheet thickness acquiring unit configured to acquire a thickness of the sheet, and a motor for actuating the pushing member, wherein the holding unit holds the pushing member at the third position by applying a holding current to the motor, and wherein the holding current in a case the thickness of the sheet acquired by the sheet thickness acquiring unit is more than a predetermined thickness is higher than the holding current in a case the thickness of the sheet obtained by the sheet thickness acquiring unit is thinner than a predetermined thickness.

8. The sheet folding apparatus according to claim 1, further comprising:

a sheet thickness acquiring unit configured to acquire a thickness of the sheet, wherein in case the thickness of the sheet acquired by the sheet thickness acquiring unit is more than a predetermined thickness, the pushing member is moved from the second position to a fourth position at the upstream side more than the third position in the conveyance direction to thereby push a part of the sheet between the pair of folding guides, wherein in a case the pushing member is moved to the fourth position, the pair of folding rollers restarts rotation from the stop state to a predetermined direction before the pushing member arrives at the fourth position, wherein in a case the pushing member arrives at the fourth position, the pair of folding rollers rotates in a reverse direction with respect to the predetermined direction, and moves the leading portion of the sheet for a predetermined amount in the reverse direction relative to the conveying direction, wherein the pushing member moves from the fourth position to the third position in a state where rotation in the reverse direction of the pair of folding rollers is stopped, wherein in a case the pushing member moves from the fourth position to the third position, the pair of folding rollers restarts rotation in the predetermined direction from the state where the rotation in the reverse direction is stopped before the pushing member arrives at the third position, and wherein the pair of folding rollers rotates in the predetermined direction to convey the sheet to thereby form the first fold line on the sheet pushed between the pair of folding guides by the pushing member, and to further form the second fold line on the sheet where the first fold line is formed by further conveying the sheet where the first fold line is formed.

9. The sheet folding apparatus according to claim 2, wherein the sheet with the predetermined thickness is a sheet with 91 g/m$^2$.

10. The sheet folding apparatus according to claim 2, wherein the sheet with the predetermined thickness is a sheet with 105 g/m$^2$.

11. The sheet folding apparatus according to claim 1, wherein in a state where the pushing member is in the third position, a leading portion of the pushing member in the conveyance direction is located between the pair of guide members, and wherein in a case the leading portion of the pushing member arrives at a position, which is the upstream side of the third position, entering between the pair of folding guides, the pair of folding rollers restarts rotation from a stop state to a predetermined direction.

12. The sheet folding apparatus according to claim 1, wherein in a state where the pushing member is in the third position, a leading portion of the pushing member in the conveyance direction is located between the pair of guide members, and wherein in a case the leading portion of the pushing member arrives at a position, which is the downstream side of the first position and the upstream side of the third position in the conveyance direction, the pair of folding rollers restarts rotation from a stop state to the predetermined direction.

13. An image forming apparatus, comprising:

an image forming portion configured to form an image on a sheet; and a sheet folding apparatus configured to perform folding processing on the sheet discharged from the image forming apparatus, the sheet folding apparatus being the sheet folding apparatus according to claim 1.

* * * * *